US006266867B1

(12) United States Patent
Kern

(10) Patent No.: US 6,266,867 B1
(45) Date of Patent: Jul. 31, 2001

(54) METHOD OF MAKING A RELAY

(75) Inventor: Josef Kern, Berlin (DE)

(73) Assignee: Tyco Electronics Logistics Aktiengesellschaft, Steinbach (CH)

( * ) Notice: Subject to any disclaimer, the term of this patent is extended or adjusted under 35 U.S.C. 154(b) by 0 days.

(21) Appl. No.: 09/446,061

(22) PCT Filed: Sep. 15, 1998

(86) PCT No.: PCT/DE98/02729

§ 371 Date: Dec. 16, 1999

§ 102(e) Date: Dec. 16, 1999

(87) PCT Pub. No.: WO99/22392

PCT Pub. Date: May 6, 1999

(30) Foreign Application Priority Data

Oct. 24, 1997 (DE) ..... 197 47 166

(51) Int. Cl.[7] ..... H01F 7/06

(52) U.S. Cl. ..... 29/602.1; 29/602.1; 29/606; 335/151; 335/152; 335/153; 335/202

(58) Field of Search ..... 29/602.1, 606; 335/151, 152, 153, 202

(56) References Cited

U.S. PATENT DOCUMENTS

| | | | | |
|---|---|---|---|---|
| 4,145,805 | * | 3/1979 | Smith | 29/605 |
| 4,163,314 | * | 8/1979 | Sauer | 29/593 |
| 4,177,439 | * | 12/1979 | Smith | 335/151 |
| 4,195,276 | * | 3/1980 | Rauterberg | 335/151 |
| 4,225,836 | * | 9/1980 | DeMaesschalck | 335/153 |
| 4,232,281 | * | 11/1980 | Smith | 335/152 |
| 4,356,465 | * | 10/1982 | Agatahama | 335/128 |
| 4,533,889 | * | 8/1985 | Knight | 335/199 |
| 4,596,972 | | 6/1986 | Knight et al. . | |
| 4,611,392 | * | 9/1986 | Bell | 29/602 R |
| 4,656,733 | * | 4/1987 | Maenishi | 29/602 R |
| 4,742,610 | * | 5/1988 | Kimpel | 29/602 R |
| 4,752,754 | * | 6/1988 | Strauss | 335/151 |
| 5,038,126 | * | 8/1991 | Becker | 335/202 |
| 5,093,979 | | 3/1992 | Kwapisz . | |
| 5,220,720 | * | 6/1993 | Becker | 29/593 |
| 5,315,275 | * | 5/1994 | Hoffmann | 335/86 |
| 5,963,116 | * | 10/1999 | Endoh | 335/151 |
| 5,990,770 | * | 11/1999 | Doneghue | 335/78 |

FOREIGN PATENT DOCUMENTS

| | | |
|---|---|---|
| 34 28 595 A1 | 2/1986 | (DE) . |
| 35 38 627 A1 | 5/1987 | (DE) . |
| 33 11 012 C2 | 2/1990 | (DE) . |
| 39 35 351 A1 | 4/1991 | (DE) . |
| 42 43 854 C1 | 3/1994 | (DE) . |
| 195 31 046 A1 | 2/1997 | (DE) . |
| 9-185933 | 7/1997 | (JP) . |

* cited by examiner

*Primary Examiner*—Lee Young
*Assistant Examiner*—Paul D. Kim
(74) *Attorney, Agent, or Firm*—Schiff Hardin & Waite

(57) ABSTRACT

A method of manufacturing a relay wherein the relay has a coil body that is formed by plastic injection molding. The method further includes the step of embedding into the coil body injection mold a contact spring terminal pin and a number of fixed contact carriers and coil terminal pins. The method also includes the step of embedding a core into the coil body injection mold.

12 Claims, 6 Drawing Sheets

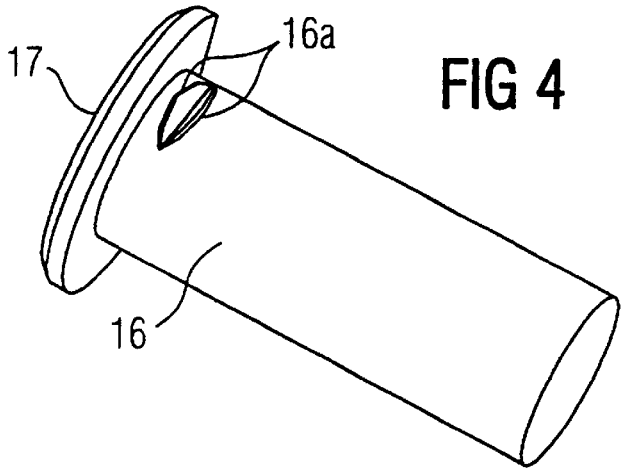
FIG 4
FIG 5
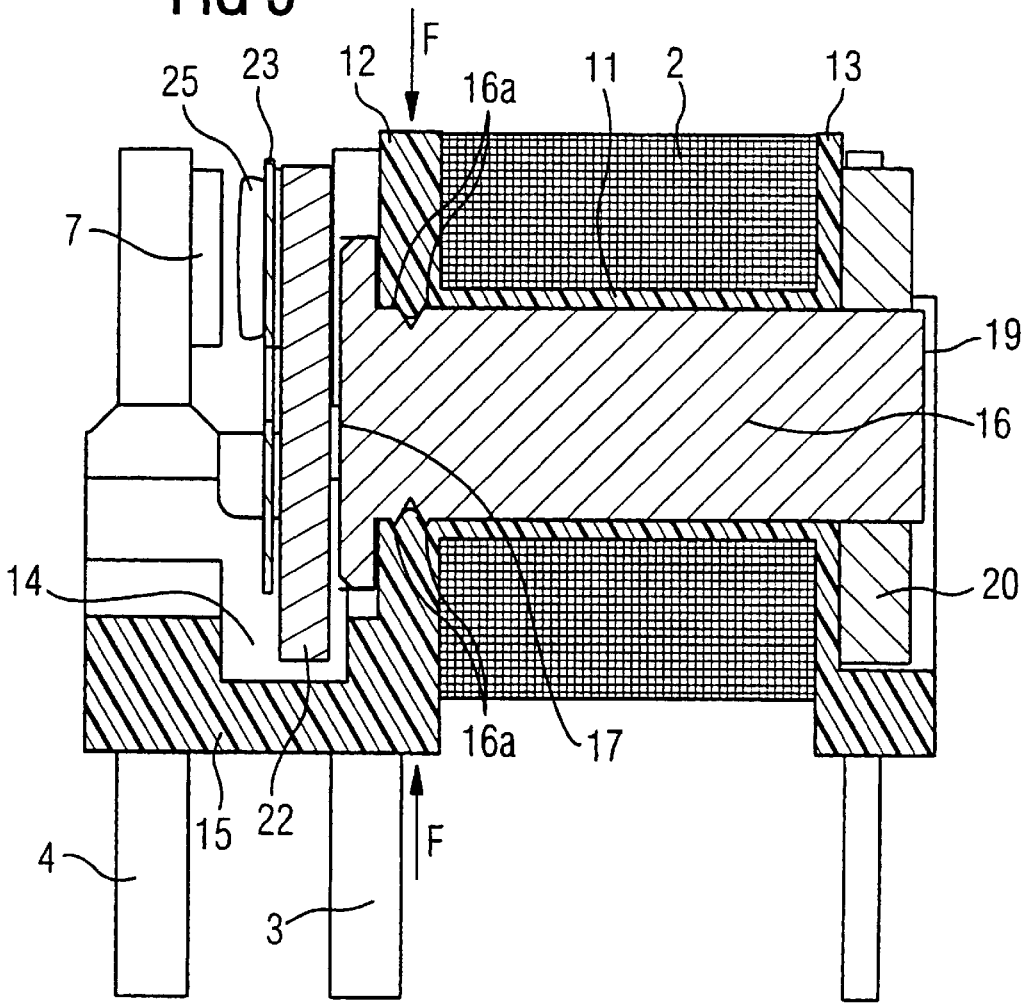

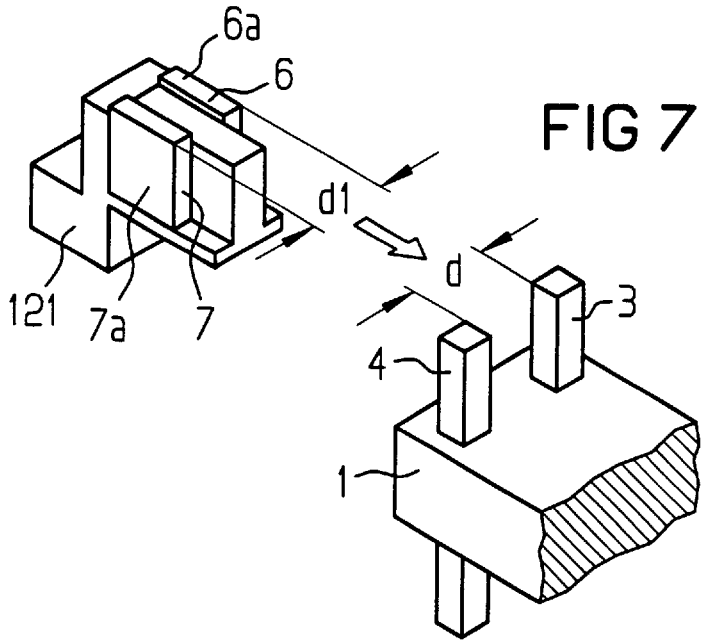
FIG 7
FIG 8
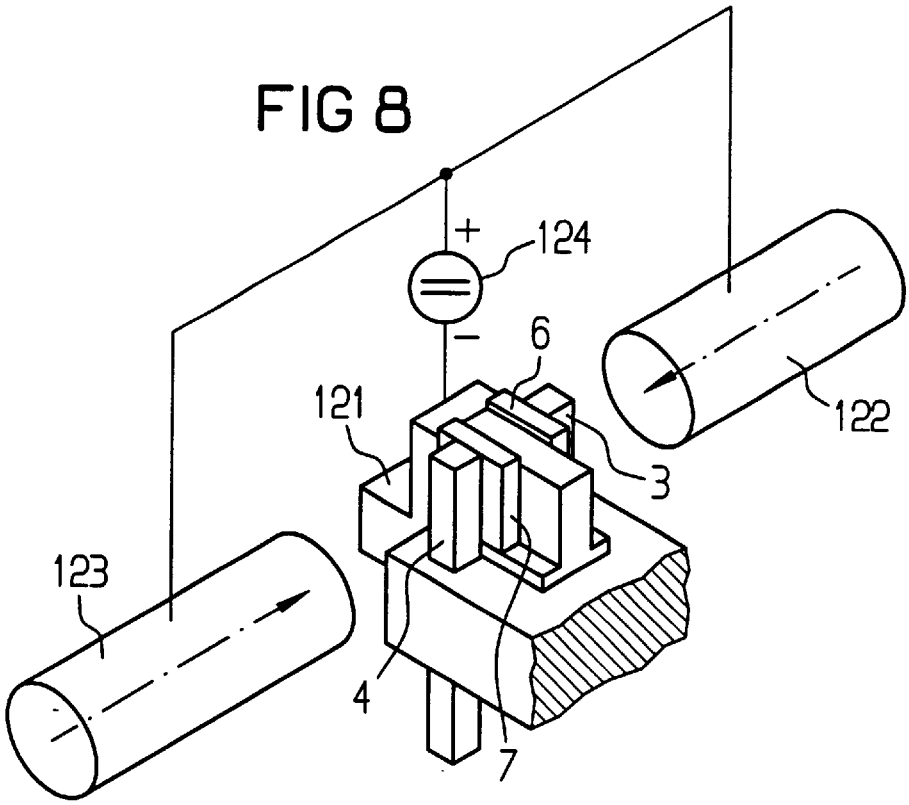

METHOD OF MAKING A RELAY

BACKGROUND OF THE INVENTION

1. Field of the Invention

The present invention belongs to the field of electronic component manufacturing. In particular, the present invention belongs to the field of manufacturing relays.

2. Description of the Prior Art

Typical relay construction is disclosed, for example, by U.S. Pat. No. 4,596,972. Therein, a contact spring arcuately surrounds an armature bearing and has its terminal section secured to a ferromagnetic yoke, wherein the yoke in turn forms a downwardly applied terminal pin. Given such a relay, where load current is conducted over the yoke, the current path in the relay is comparatively long to the terminal. Moreover, the ferromagnetic yoke material has limited conductivity. This has an unbeneficial effect for the switch capability of high currents when the terminal pin, having a relatively small cross section, is manufactured of the same material as the yoke. Moreover, a terminal pin applied to the yoke requires an additional outlay when the relay housing is to be sealed.

In similarly constructed relays that are designed for high load currents, it is also known to conduct the load current from a terminal pin secured in a base via a stranded copper conductor directly to the contact spring and to the contact piece secured thereto German Patent Document DE 34 28 595 C2. In this way, the yoke need not carry the load current. The use of the stranded conductor, however, requires additional outlay for material and assembly.

Given these known relays, the fixed contact carriers and, potentially, the contact spring/terminal pin themselves, are respectively manufactured as punched parts and mounted by a plug-in procedure in pre-shaped shafts and clearances of the coil body or of a base. These parts are subsequently affixed by a notching process or by self-pressing. This structure has the disadvantage that the parts either are not seated firmly with positive lock in the plastic part due to tolerance reasons, or that particles are abraded during assembly as a result of overlaps of parts. These particles can lead to problems later in the relay, for example on the contacts, in the armature bearing or in the working air gap. A high outlay must be exerted in the manufacture in order to eliminate the particles with blower or suction devices.

Although it is known to punch discrete parts, such as contact carriers, of sheet metal and to extrusion-coat these parts either individually or interconnectedly into strips, this type of manufacture has the disadvantage that the parts must be inserted into the injection molding form. Moreover, strip fabrication requires a high consumption of material. In both instances, a high outlay is required in order to adapt the injection molding form to the punching tools to enable a good sealing of the form in the region of the punch burrs.

The present invention overcomes these problems of the prior art by offering an uncomplicated and economical method of producing a relay comprising a coil body having a coil tube, two coil flanges and a winding, a core having an L-shaped yoke, an armature connected to a contact spring, a terminal pin for the contact spring, and at least one first fixed contact carrier having a fixed contact.

SUMMARY OF THE INVENTION

Accordingly, it is an object of the present invention to provide a method of manufacturing a relay having only a few parts.

It is another object of the invention to provide a method of manufacturing a relay that uses intermediate parts in a material-saving and waste-free way.

It is a further object of the invention to provide a method of manufacturing a relay that is economical and of a high quality.

DESCRIPTION OF THE DRAWINGS

FIG. 4 shows an element of a relay manufactured according to the present invention.

FIG. 5 illustrates another cross-sectional view of a relay manufactured according to the present invention.

FIGS. 7 and 8 show a schematic of a relay manufactured according to the present invention.

DESCRIPTION OF THE PREFERRED EMBODIMENTS

A relay manufactured according to the present invention is shown in FIGS. 1 through 5.

Figure 1:
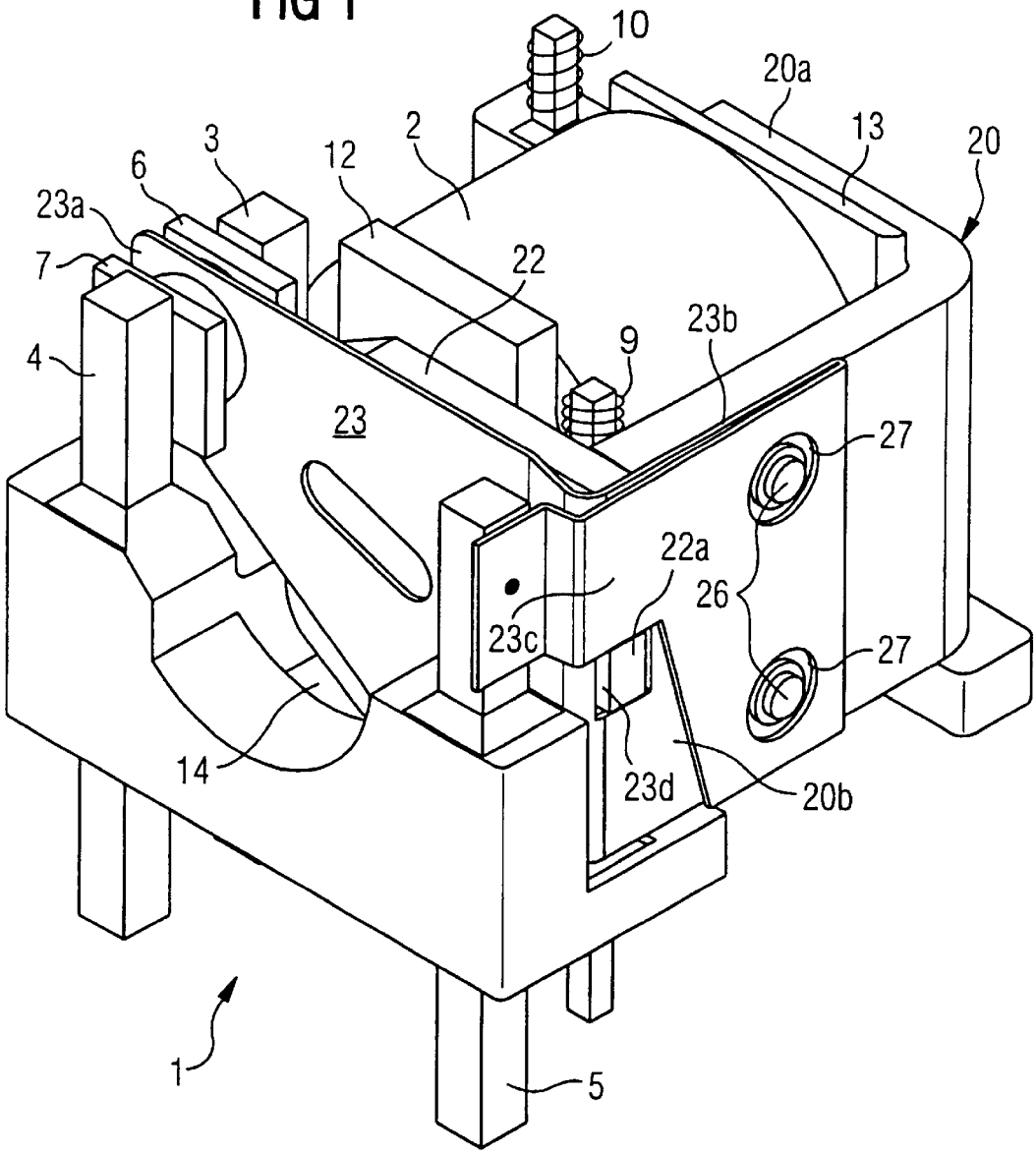
FIG. 1 shows a relay manufactured according to the present invention.

Referring to FIG. 1, the relay includes a coil body 1 with a coil tube 11, a first flange 12 and a second flange 13. The first flange 12 forms a continuation in which a switch space 14 is formed. A winding or coil 2 is applied on the coil tube 11.

FIG. 5 shows that the switch space 14 is downwardly terminated with a floor 15 and defines the terminal side of the relay.

Figure 2:
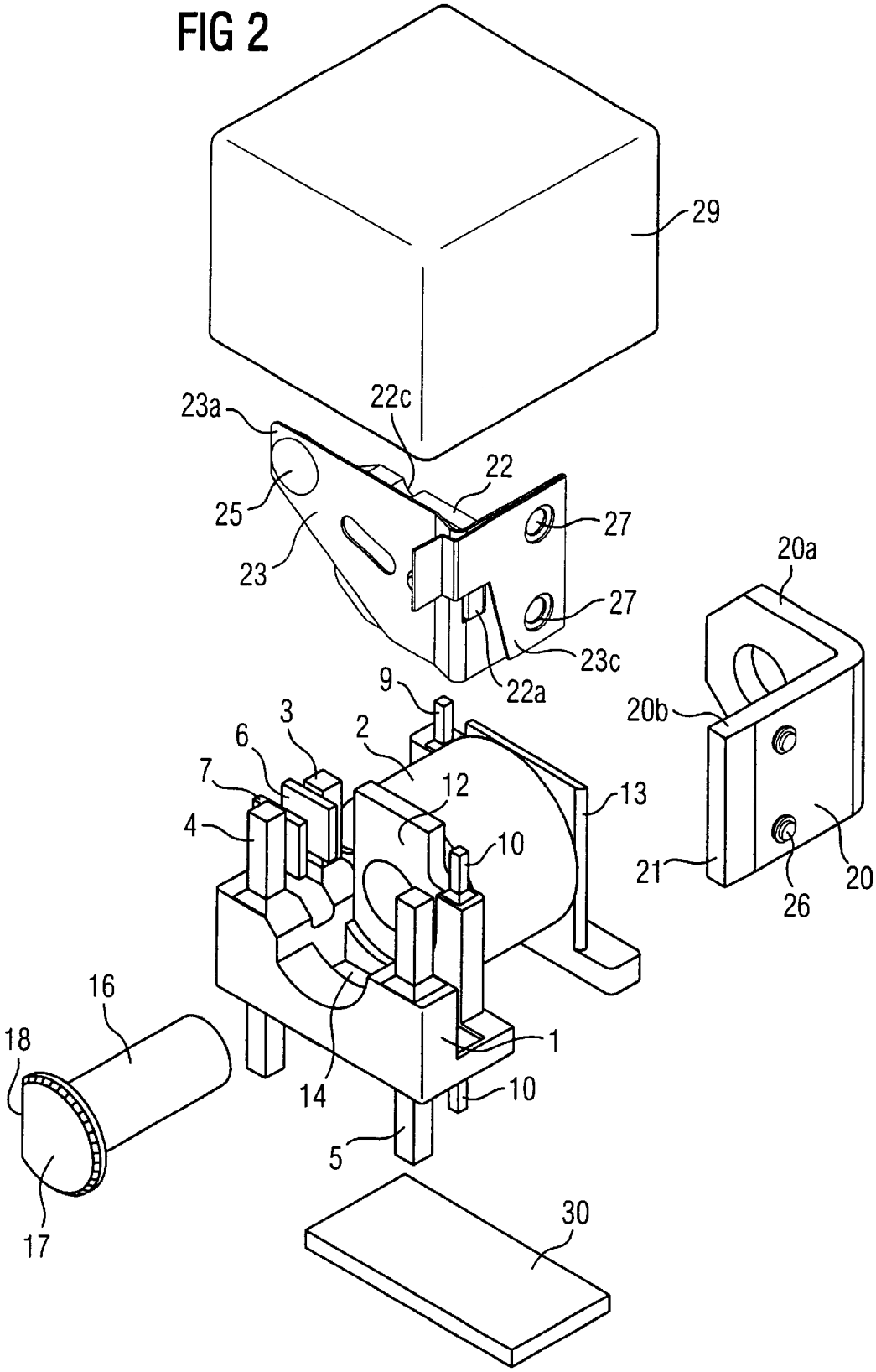
FIG. 2 illustrates a partially assembled relay manufactured according to the present invention.

With reference mainly to FIG. 2, which shows the relay in a partially assembled condition, it can bee seen that, fixed contact carriers 3 and 4 and a contact spring/terminal pin 5 are embedded in the continuation of the first flange 12 by injection molding. The contact spring/terminal pin 5 is a half-finished good in the form of a wire having a quadratic cross-section. What is meant by half-finished goods is that the article is in an intermediate stage of production and is not fully completed. In other words, the goods are in a rough state, but nevertheless are still useful for the purpose intended.

The contact spring/terminal pin 5 is made of a highly conductive material, such as copper. Instead of using wire having a quadratic cross-section, wire having a rectangular cross-section or having a round cross-section could also be used for the contact spring/terminal pin 5.

Fixed contact carriers 3 and 4 are each respectively provided with fixed contact pieces at the surfaces facing toward one another, namely a first fixed contact piece 6 which acts as cooperating make-contact, and with a second fixed contact piece 7 that serves as cooperating break contact. The fixed contact pieces 6 and 7 are each cut from a band of half-finished contact material, and are welded or hard-soldered to the fixed contact carriers 3 and 4.

Two further wires having a preferably smaller cross section are arranged diagonally offset in the first flange 12 and in the second flange 13 as coil terminal pins 9 and 10, respectively. The coil terminal pins 9 and 10 are embedded in the same way as the load terminals. The coil terminal pins 9 and 10 are preferably implemented with a quadratic cross-section in order to better achieve a firm seat when wrapped for end connection, as will be discussed later. Connection preferably involves WIG welding or WIG soldering, wherein a flux-free and, therefore, particle free connection is achieved.

A round or rectangular, soft-magnetic core 16 having a one piece pole plate 17 cut-off at one side along the line 18, is located in the coil tube 11. As a result, a large pole surface is obtained, particularly at the side directed toward the armature bearing. Thus, an adequately large insulating distance from the fixed contact carrier 3 is provided at the opposite side. The core end 19 lying opposite the pole plate 17 projects from the coil tube 11 and is connected to a leg 20*a* of an L-shaped yoke 20. A second leg 20*b* extends laterally parallel to the coil axis such that its end forms a bearing edge 21 for armature 22.

Figure 3:
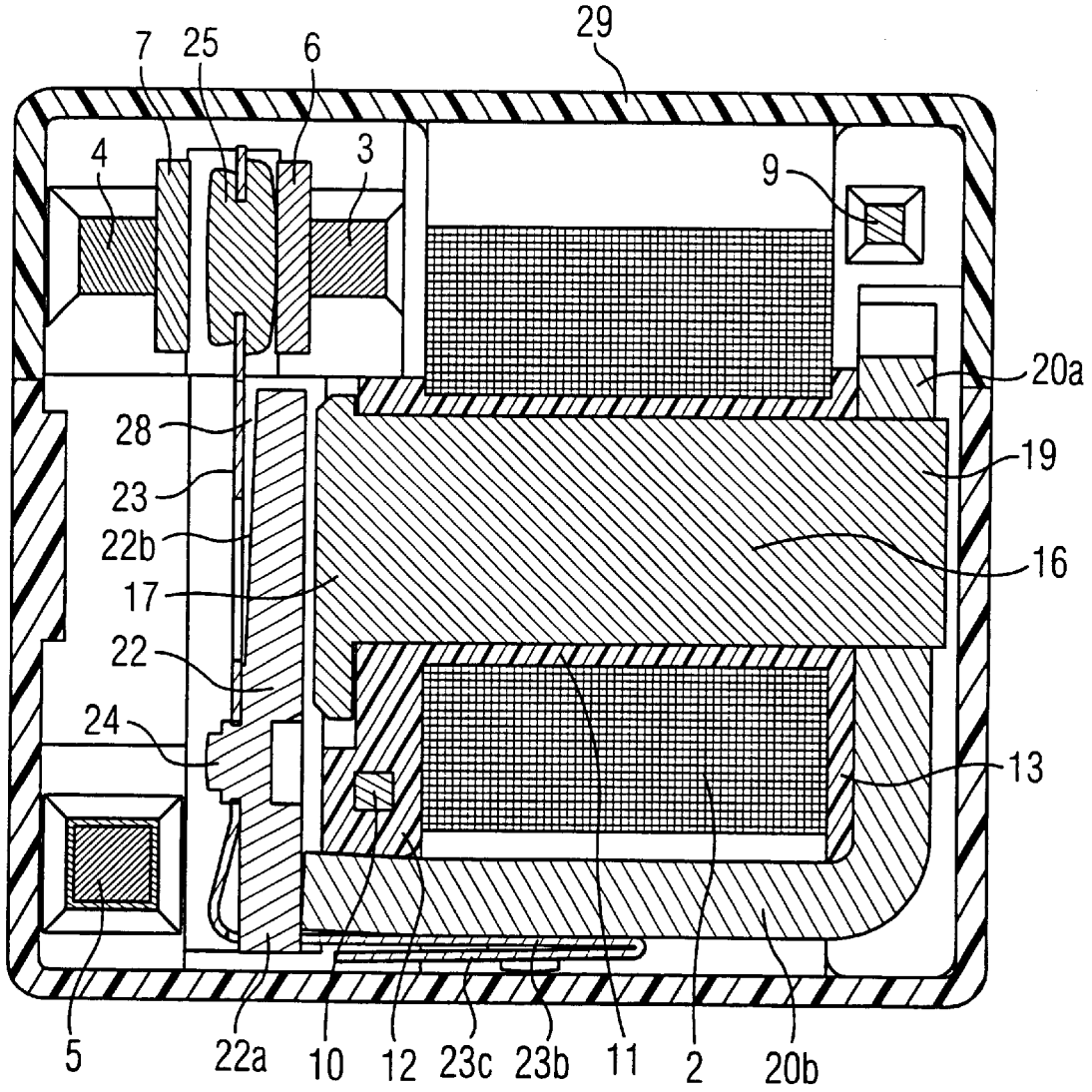
FIG. 3 shows a cross-sectional view of a relay manufactured according to the present invention.

FIG. 3 shows a horizontal longitudinal section of a completely assembled relay.

When the coil body 1 is formed, a core 16 can be embedded therein, such as in the coil tube 11. A need for plugging is eliminated because, the core end 19 projecting beyond the coil body 1, serves the purpose of centering the core 16 in the injection molding tool 100.

In order to assure the resistance of the armature 22 against being bent off, such as by an excess stroke, the armature 22 is provided with a free coining 22*b* in the region below a movable contact spring end, so that an air gap 28 arises between a contact spring 23 and the armature 22. As a result of lateral constriction 22*c*, a rated bending point is prescribed. This enables an increase in the excess stroke when the armature 22 is slightly bent off given an influence of force of the coil axis.

FIG. 4 shows the pluggable core 16 of the relay. Projecting nubs 16*a* are coined on the circumference of the core 16 in the proximity of the pole plate 17. In the assembled condition, projecting nubs 16*a* have an excess dimension lying in the region of the first coil flange 12 and yield a positive lock given later relaxation of the thermoplastic material. The core 16 fits into the coil tube 11, as shown in FIG. 5.

FIG. 5 shows a vertical longitudinal section through the relay.

A bearing is affixed to the core pole surface on the pole plate 17 and to the bearing edge 21 of the yoke 20 in the coil member.

The core 16 and the yoke 20 are connected, for example, with a notched connection in the region of the coil flange 13, such that the pull surface of the pole plate 17 and the yoke bearing edge 21 align with one another. Tolerances of the two parts are suppressed and an optimum force of magnetic attraction for the armature 22 is achieved. Compensation of the tolerances and, thus, adjustment of an excess stroke, is achieved by inserting the notched yoke/core unit in the axial direction of the coil tube 11 until the excess stroke of the armature 22 reaches its rated value. Surfaces in the working air gap and the armature bearing air gap align optimally and do not change in terms of their mutual allocation. The magnet system is adapted to the position of the contact set.

Relaxation of the thermoplastic material of the coil body 1 is accelerated due to the additional influence of forces F at opposite sides of the coil flange 12 perpendicular to the coil axis. Thus, firm seating of the core 16 in the region of the first coil flange 12 is assured after adjustment.

Contact spring 23 is connected to the armature 22 via a riveted location 24 whose end 23*a* projects beyond the armature. The contact spring 23 carries with it movable contact 25 that collaborates as a center contact with the two fixed contact pieces 6 and 7. Contact spring 23 can be implemented as a riveted contact, as in the illustrated example, or can be formed by two contact pieces welded or soldered opposite one another and cut off from a piece of precious metal. In the region of the armature bearing, the contact spring 23 has a fastening section 23*b* that is bent over the borne armature end in the form of a curl or loop, and can be secured lying flat on the yoke leg 20*b* with rivet nubs 26, or with resistance welding or laser welding.

Due to pre-stressing, the fastening section 23*b* of the contact spring 23 produces an armature restoring force. Contact spring 23 has a terminal section 23*c* extending beyond the fastening section 23*b* that is folded by 180° over the fastening section 23*b*. An end of the contact spring 23*b* is secured to the terminal pin 5 by welding or hard soldering. The terminal section of the contact spring 23 serves only for carrying current and has no influence on the restoring force of the armature 22.

The armature 22 is provided with clearances 27 in the region of the rivet nubs 26, or with spot welds, so that it is not co-riveted or co-welded. For impact protection, the armature 22 has a safety nose 22*a* that projects into a rectangular hole 23*d* punched in the fastening section 23*b* that secures movement of the armature 22 in an axial direction relative to the coil 2.

A relay manufactured according to the present invention can be provided with a protective cap 29, as shown FIG. 2. A bottom plate 30 covering the coil winding space in a downward direction can be placed between the two flanges 12 and 13 in the region of the bottom side. A gap is formed between the cap 29, the bottom plate 30 and the coil member 1. Subsequently, the gap between the cap 29, the bottom plate 30 and the coil member 1 can be sealed with a casting compound.

The bottom plate 30, which covers only the coil winding space of the coil body 1, causes no particle abrasion. This is because the wire-shaped terminals, namely the fixed contact carriers 3 and 4, the contact spring/terminal pin 5, and the coil terminal pins 9 and 10, are embedded into the flanges, need not pass through the bottom plate 30, and require no clearances in the bottom plate 30. The bottom plate 30 can also be connected in one piece to the cap 29 with a film hinge 31. In this case, the bottom plate 30 is pivoted over the coil winding space after mounting of the cap 29 before sealing with the casting compound. After housing cap 23 is put in place and the bottom plate 30 is introduced, the relay can be sealed on a printed circuit board with a casting compound.

Figure 6:
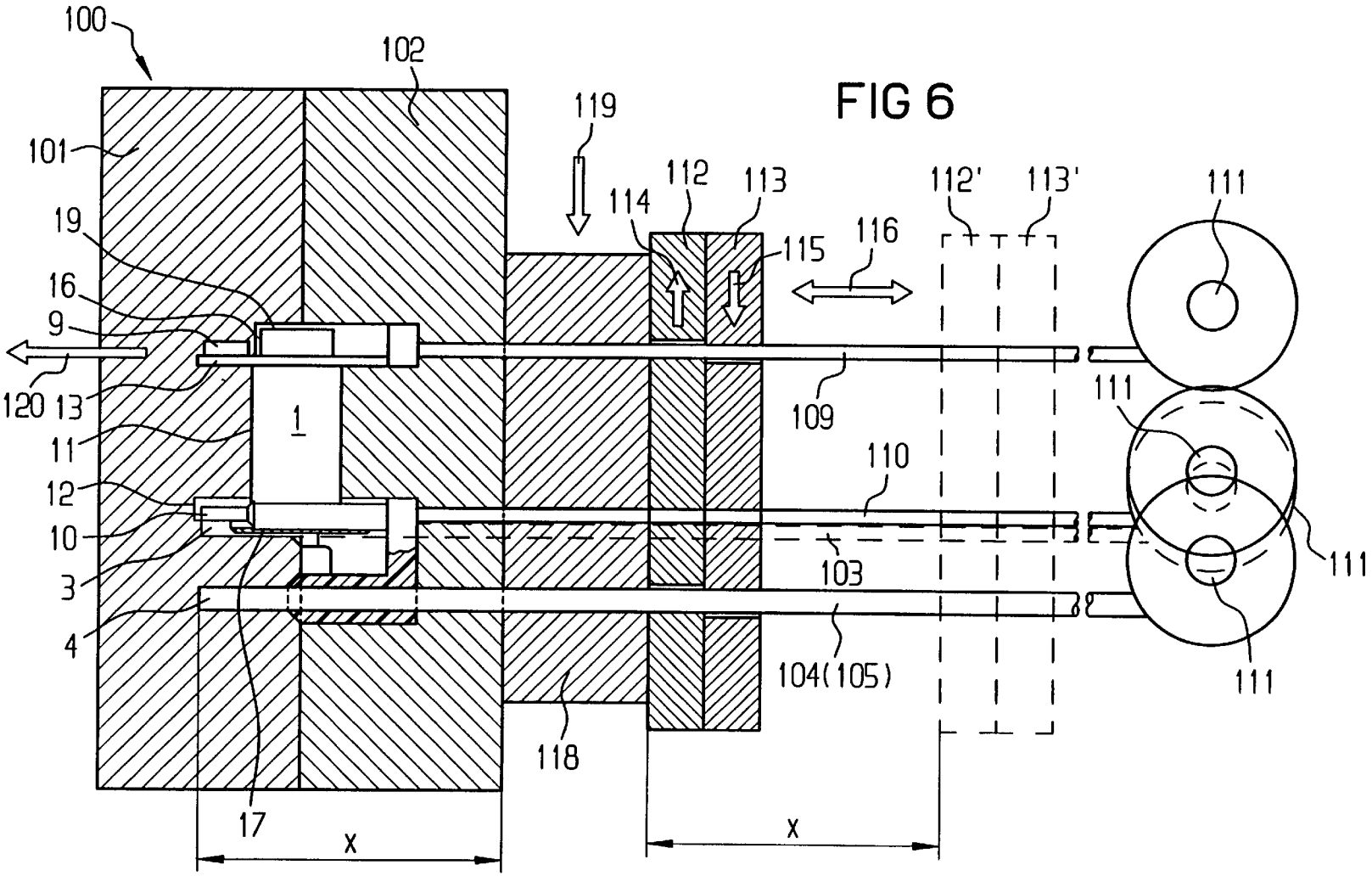
FIG. 6 shows a schematic of a relay manufactured according to the present invention.

FIG. 6 schematically shows molding of the thermoplastic coil body 1.

An injection mold tool 100 made up of two mold halves 101 and 102 has a mold cavity for the coil body 1. The coil body 1 is fashioned in a form with the coil tube 11 and flanges 12 and 13. Before injecting the thermoplastic material into the mold, fixed contact carriers 3 and 4, contact spring terminal pin 5 (not visible) and coil terminal pins 9 and 10 are respectively taken from corresponding supply reels 111 as respective wire sections. The respective wire sections 111 have a length X of corresponding semi-finished wires 103, 104, 105 (not visible) or 109 and 110, and are pushed into the mold.

Introduction of the wire sections 111 into the mold progresses via clamp jaws 112 and 113 that are moved oppositely toward one another according to the arrows 114 and 115. The clamp jaws 112 and 113 move in a direction perpendicular to the longitudinal wire direction in order to clamp the wires fast and push them in the direction of the double arrow 116 by the length X. The wires are still retained by the clamp jaws 112 and 113 during the injection molding and are cut off only after the injection process is completed. The cutting is done with a parting tool 118 moved in the direction of the arrow 119 together with the clamp jaws 112 and 113. The parting tool 1 18 shears the wires off at the outside of the mold part 102.

Subsequently, clamp jaws 112 and 113 are loosened and in turn moved in the length X toward the right in order to again clamp the wires in the position 112' and 113' and push new sections 111, also having the length X, into the mold.

However, it is conceivable to cut the wires off before injection molding. In this case, the wires would have to be fixed in the mold in some other way.

Core 16 is also injection molded into the coil body 1, and the mold tool 100 has corresponding receptacles for positioning the core 16. Cylindrical end section 19 centers the pole plate 17 in the mold 100 at the other end before the pole plate 17 is sealed in the injection mold 100. The finished coil body 1 is removed from the mold 100, and the direction of opening the mold 100 is indicated with the arrow 120.

FIGS. 7 and 8 show two different application stages of the fixed contact pieces 6 and 7.

In FIG. 7, fixed contact pieces 6 and 7 are soldered onto the fixed contact carriers 3 and 4, as shown in FIGS. 7 and 8. Fixed contact pieces 6 and 7 form the cooperating make-contact and cooperating break-contact, which are fabricated of a half-finished band goods, are held in recesses of inner electrode 121. Fixed contact pieces 6 and 7 can by held under-pressure via a channel (not shown) in the inside of the inner electrode 121. The fixed contact pieces 6 and 7 are pushed between the fixed contact carriers 3 and 4 with the electrode 121, since the fixed contact carriers 3 and 4 have been injected into the coil body in the above-described way with the spacing dimension d.

Fixed contact pieces 6 and 7 each include an outside 6*a* and 7*a* respectively, which are provided with a hard solder layer, for example, silphos. With this hard solder layer, the width dimension dl of the inner electrode with the fixed contact pieces 6 and 7, slightly exceeds the inside dimension d between the fixed contact carriers 3 and 4. Thus, fixed contact carriers 3 and 4 are somewhat spread open upon introduction of the inner electrode 121 with the fixed contact pieces 6 and 7.

As shown in FIG. 8, two outer electrodes 122 and 123 are subsequently pressed in the direction of the arrow against the fixed contact carriers 3 and 4 oppositely to one another. The solder layer on the surfaces 6*a* and 7*a* of the fixed contact pieces 6 and 7 is melted with welding current applied between the inner electrode and the outer electrodes from a welding current source 124. So much solder is thereby displaced that the two fixed contact carriers 3 and 4 return into their previous position, contact spacing d, and the contact spacing between the fixed contact pieces 6 and 7 assumes a predetermined dimension. Calibration of the contact spacing is provided in this way.

The method of the present invention does not require complicated assembly steps to make the terminal parts for the coil or the load circuits. Instead, the method of the present invention, in a single and cost-beneficial step during the injection molding process, efficiently uses half-finished wire goods that are cut without waste. Moreover, no joining processes, wherein metallic relay parts are joined with excess dimension into the thermoplastic injection molded part of the coil body 1, occur in the manufacture of the relay. Thus, no plastic particles are scraped off or abraded off, which tend to disturb the electrical contacts of the relay.

In addition, the coil 2 is wound in a standard way, wherein the winding ends are connected to the terminal pins 9 and 10. Since the coil terminal pins 9 and 10 preferably comprise a quadratic cross-section, the winding ends adhere to them better during wrapping. Thereafter, the winding ends are connected to the terminal pins by a flux-free joining method such as, for example, WIG welding.

The magnet system is completed by pressing and notching L-shaped, soft-magnetic yoke 20 onto the projecting core end 19 in the region of the flange 13, and armature 22 with contact spring 23 is introduced. The contact spring 23 has a fastening section 23*b* which is riveted or resistance-welded or laser-welded onto the yoke 20. The contact spring 23 also has a terminal section 23*c*, which is brought into contact with the terminal pin 5.

In summary, as discussed above, a method of making a relay according to the present invention, involves injecting into an injection mold and affixing therein, a contact spring/terminal pin, a fixed contact carrier and coil terminal pins as sections of half-finished wire goods; forming a coil body by injecting plastic into the injection mold, such that a switch space is formed in a first coil flange and the fixed contact carrier is embedded into the first coil flange in the region of the switched space. Likewise, the contact spring/terminal pin is embedded into one of the flanges; cutting-off the wire sections from their respective half-finished wire goods before or following the injection process; welding or hard-soldering a fixed contact onto a fixed contact carrier; providing the coil body with a winding, and arranging the core and the yoke, such that a free yoke end forms a bearing edge for the armature; seating the plate-shaped armature, such that a bearing edge of the contact spring embraces the bearing location with an angled-off section and has its contacting, free end residing opposite the at least one fixed contact; and connecting a terminal section of the contact spring to the contact spring/terminal pin.

The half-finished wire goods are used as load circuit terminals. The wire goods are inserted directly into the injection molding form from a supply reel and embedded therein. Thus, no punching or bending tools are required. The coil terminals employed in the standard way are also co-injected in the same way in the form. The wire can be cut directly by the injection tool before the injection molding or after the injection molding, so that no waste whatsoever occurs. Due to the use of drawn wires having a simple, preferably round or rectangular profile, the sealing of the injection molding form is also unproblematical since no punch burrs or the like need be taken into consideration.

Since the relay includes no plug-in punched parts, no plastic particles are scraped off during assembly. Such scraped off plastic particles tend to become deposited onto the contact surfaces or pole surfaces, and are capable of deteriorating the function of the relay. Due to the low tolerances of the drawn half-finished wire goods having an angular or round cross section and the geometrically simple clearances in the injection tool that can be precisely manufactured in an unproblematical way, an injection skin or burr formation is avoided.

In order to firmly seat the straight wires in the thermoplastic injection molded part, one or more sides of the wires can be provided with knurling or with notches. Knurling can be cost-beneficially produced in a standard knurling roller press.

In the simplest embodiment, a relay made according to the present invention has only one fixed contact carrier 3 that registers with the contact spring 23 as make-contact or break-contact, and is correspondingly arranged at the one or other side of the spring end with the movable contact. In the same way, a switch-over contact can be produced, wherein a second fixed contact carrier 4 is embedded in the coil body 1 lying opposite the first in this case, and is provided with a fixed contact.

The contact spring/terminal pin 5 can be formed of a quadratic wire, just like the fixed contact carriers 3 and 4. In this way, the contact spring/terminal pin 5 and the fixed contact pieces 6 and 7 can be welded or soldered onto the contact carrier 3 and 4 with a large transition area. The fixed contact pieces 6 and 7 themselves are likewise preferably cut off as sections from half-finished goods, so that waste does not occur.

The fixed contact pieces 6 and 7 are secured on the fixed contact carriers 3 and 4 by electro-welding or soldering. An inner electrode 121 is arranged between the two fixed contact pieces 6 and 7, and the outer electrodes 122 and 123 are applied to the two fixed contact carriers 3 and 4, such that the thickness of the inner electrode corresponds to a predetermined spacing between the fixed contact pieces 6 and 7. Calibration of the contact spacing is obtained via a hard solder layer located at the fixed contacts is melted during the soldering process and is more or less displaced for setting the contact spacing.

The contact spring/terminal pin 5 is also embedded into the first coil flange 12 in the region of the switch space. The terminal section of the contact spring is directly secured to a section of the contact spring/terminal pin 5 proceeding parallel to the bearing edge of the yoke. The armature 22 has its bearing edge lying between the yoke end and the terminal pin 5, whereas the terminal section of the contact spring is conducted past the bearing edge of the armature to the terminal pin 5 and is secured thereto, preferably being welded or hard-soldered.

The core arranged in the coil tube 11 preferably has a pole plate 17 with the pole surface eccentrically enlarged toward the armature bearing. As a result thereof, an adequate insulating distance to the fixed contact carriers 3 and 4 can be produced. Thus, even in view of small relay dimensions, an adequately large pole surface can be obtained. Core 16 can be plugged into the coil body 1 during the manufacture thereof, so that a subsequent plugging procedure is eliminated. In this case, the core 16 can have a round or a rectangular cross-section.

However, it is also possible to subsequently plug a round core into a through opening of the coil body 1. In this case, it is advantageous to provide nubs 16*a*, coined on the surface of the core 16 in the proximity of the pole plate 17. The nubs 16*a* form a positive lock given the later relaxation of the thermoplastic coil body material and, thus, produce a mutual positional fixing of the pole plate 17 and the bearing edge 21 of the yoke 22.

The contact spring 23 has a fastening section that angularly surrounds the armature bearing secured on the yoke 20. A terminal section folded over the fastening section is conducted to the terminal pin 5 and connected thereto. A large spring cross-section is available for conducting load current up to the terminal pin 5. Therefore, the relay is capable of handling high load currents.

By embedding all load terminals in the region of the one coil flange, the terminals pass through the floor of the switch space 14 in a sealed fashion. Therefore, a protective cap 29 placed onto the coil body 1 need only be sealed along the outside contour of the first coil flange 12. The same is true for the second coil flange 13 lying there opposite, where the terminal pin 5 is likewise already tightly embedded. Thus, only the space below the coil winding 2 remains, this being capable of being closed in a simple way with a plate 30 and being sealed along its edges.

Although modifications and changes may be suggested by those skilled in the art, it is the intention of the inventors to embody within the patent warranted hereon all changes and modifications that may reasonably and properly come under the scope of their contribution to the art.

What is claimed is:

1. A method for manufacturing a relay comprising the steps of:

placing a contact spring terminal pin and a plurality of fixed contact carriers and a plurality of coil terminal pins into a coil body injection mold for producing a plurality of respective wire elements;

cutting at least a portion of each of said wire elements;

forming a coil body by injecting plastic into the coil body injection mold, said coil body including a coil tube having a first and a second coil tube end and two coil flanges, said two coil flanges including a first coil flange and a second coil flange being connected to said respective first and second coil tube ends, said first coil flange including a switch space, said switch space including each of said plurality of fixed contact carriers being embedded into said first coil flange, said coil body further including said contact spring terminal pin being embedded in one of said two flanges;

welding a fixed contact to each one of said fixed contact carriers;

attaching a coil, a core and a yoke having a yoke bearing edge to said coil body;

placing an armature against said yoke bearing edge, said armature being mounted to a contact spring, said contact spring including a contact spring angled member having a first, second and terminal contact spring end, said first contact spring end embracing said yoke bearing edge, said second contact spring end being positioned adjacent to each of said fixed contact carriers; and connecting said contact spring terminal end to said contact spring terminal pin.

2. A method according to claim 1 further comprising the step of embedding two fixed contact carriers into said coil body, each one of said two fixed contact carriers having a fixed contact.

3. A method according to claim 2 further comprising the step of attaching one fixed contact to each one of said two fixed contact carriers by a soldering device, said soldering device including two outer electrodes and an inner electrode being applied to said two fixed contact carriers, said inner electrode having an inner electrode thickness and being positioned between said two fixed contact carriers, said thickness corresponding to a predetermined contact spacing between said two fixed contacts.

4. A method according to claim 3 further comprising the step of calibrating said contact spacing by melting and re-solidifying a hard solder layer of said fixed contact of both of said two fixed contact carriers.

5. A method according to claim 1 further comprising the step of providing each of said fixed contact carriers being formed of wire having a quadratic cross section.

6. A method according to claim 1 wherein said method comprises the step of providing each of said wire elements with a notch.

7. A method according to claim 1 further comprising the steps of cutting each of said fixed contacts from a contact band element and securing said contact band element of each of said fixed contacts to each of said respective fixed contact carriers.

8. A method according to claim 1 wherein said method comprises the steps of embedding said contact spring terminal pin into said first coil flange, said contact spring terminal pin being positioned opposite of each of said fixed contact carriers, providing said contact spring with a fold for defining said contact spring first and terminal ends, and fastening said contact spring first end to said yoke wherein said contact spring terminal end is secured to said contact spring terminal pin.

9. A method according to claim 1 wherein said method comprises the step of embedding said core into said coil body injection mold.

10. A method according to claim 1 wherein said method comprises the step of axially embedding said core into said coil body by securing said core with a plurality of coined nubs.

11. A method according to claim 1 wherein said cutting of said wire elements occurs before said injection of plastic into said coil body injection mold.

12. A method according to claim 1 wherein said cutting of said wire elements occurs after said injection of plastic into said coil body injection mold.

* * * * *